US008389885B2

(12) United States Patent
Inamoto et al.

(10) Patent No.: US 8,389,885 B2
(45) Date of Patent: Mar. 5, 2013

(54) DOME SHAPED SPRING AND SWITCH

(75) Inventors: Shigenori Inamoto, Sagamihara (JP); Chikara Sekiguchi, Yamato (JP); Masahiko Aranai, Hachioji (JP)

(73) Assignee: Mitsumi Electric Co., Ltd., Tama-Shi (JP)

( * ) Notice: Subject to any disclaimer, the term of this patent is extended or adjusted under 35 U.S.C. 154(b) by 288 days.

(21) Appl. No.: 12/848,383

(22) Filed: Aug. 2, 2010

(65) Prior Publication Data

US 2011/0031099 A1 Feb. 10, 2011

(30) Foreign Application Priority Data

Aug. 6, 2009 (JP) ..... 2009-182939

(51) Int. Cl.
*H01H 1/10* (2006.01)

(52) U.S. Cl. ..... 200/513

(58) Field of Classification Search ..... 200/513, 200/512, 520–521, 406
See application file for complete search history.

(56) References Cited

U.S. PATENT DOCUMENTS

| | | | | |
|---|---|---|---|---|
| 4,439,646 | A | 3/1984 | Bouvrande | |
| 4,933,522 | A * | 6/1990 | Celander | 200/513 |
| 6,498,312 | B1 * | 12/2002 | Villain | 200/510 |
| 6,683,265 | B2 * | 1/2004 | Masuda | 200/406 |
| 2001/0035334 | A1 | 11/2001 | Andersson et al. | |

FOREIGN PATENT DOCUMENTS

| | | | |
|---|---|---|---|
| GB | 2 098 401 | A | 11/1982 |
| JP | 2000-322974 | A | 11/2000 |
| JP | 2004-139997 | A | 5/2004 |
| JP | 3753676 | B2 | 12/2005 |
| JP | 4079431 | B2 | 2/2008 |

OTHER PUBLICATIONS

Extended European Search Report (EESR) dated Jan. 27, 2011 (in English) in counterpart European Application No. 10171537.3.

* cited by examiner

*Primary Examiner* — Xuong Chung Trans
(74) *Attorney, Agent, or Firm* — Holtz, Holtz, Goodman & Chick, PC

(57) ABSTRACT

Disclosed is a dome shaped spring including: a dome shaped spring section in which buckling occurs by pushing, wherein at least a portion of a neutral face of a movable portion when buckling of the dome shaped spring section occurs is an aspherical shape.

5 Claims, 12 Drawing Sheets

DOME SHAPED SPRING AND SWITCH

BACKGROUND OF THE INVENTION

1. Field of the Invention

The present invention relates to a dome shaped spring and a switch including a dome shaped spring.

2. Description of Related Art

Conventionally, an operation section of an electronic device such as a cellular phone, etc. is known to have a configuration using a push button switch with a clicking action. The push button switch with a clicking action can provide an operator a clicking feel when the pushing is input. The push button switch with a clicking action includes a dome shaped contact spring.

As the above described push button switch, there is known a switch including a dome shaped contact spring where an entire surface is a spherical surface. With reference to FIG. 14, an apparatus configuration of a switch 100 including a conventional dome shaped contact spring where an entire surface is a spherical surface is described. FIG. 14 shows a cross sectional view of the configuration of the switch 100 including a dome shaped contact spring 21.

As shown in FIG. 14, the switch 100 includes a dome shaped contact spring 21, substrate 3, fixed contacts 4, 5 and 6. The dome shaped contact spring 21 is a spring for a contact composed of a metal conductor in a dome shape where the entire surface is a spherical surface. FIG. 14 is a cross sectional view of a face passing a movable contact 21*a* in a position in a center of a plane of the dome shaped contact spring 21.

The substrate 3 is a substrate on which the dome shaped contact spring 21 is placed. The substrate 3 is provided with fixed contacts 4, 5 and 6. The fixed contacts 4, 5 and 6 are electric contacts including a metal conductor. The fixed contacts 4 and 5 are constantly in contact with an edge section of the dome shaped contact spring 21. The fixed contact 6 is provided in a position corresponding to the movable contact 21*a* of the dome shaped contact spring 21.

The operation of switch 100 is described with reference to FIG. 15. FIG. 15 shows a characteristic of an operation load F to a displacement of the movable contact 21*a* in switch 100.

With the switch 100, the dome shaped contact spring 21 is pushed down from above by the operator. When the movable contact 21*a* of the dome shaped contact spring 21 is in contact with the fixed contact 6, the fixed contacts 4 and 5 are in an electrically conductive state with the fixed contact 6 through the dome shaped contact spring 21. With this conductive state, an electric signal showing the dome shaped contact spring 21 is pushed down is output from the operation section including the switch 100.

With such switch 100, it is assumed that the operator pushes the movable contact 21*a* of the dome shaped contact spring 21 from the above with an operation load F [gf]. In an initial position where force is not applied to the movable contact 21*a*, the operation load F and a displacement [mm] of the movable contact 21*a* in a vertical direction with respect to the substrate 3 is set to 0.

From the initial state of the switch 100, the operator pushes the switch 100 to initiate the increase of the operation load F. As shown in FIG. 15, the operation load F increases almost in proportion from displacement 0 to displacement S11. Then, buckling occurs in the dome shaped contact spring 21 at operation load F11 corresponding to displacement S11. Then, the center portion of the dome shaped contact spring 21 is inverted and the movable contact 21*a* is displaced with an operation load smaller than the operation load F11. Next, the operation load continues to decrease until the movable contact 21*a* reaches the displacement S12 to be in contact with the fixed contact 6. Then, when the operation load F12 corresponding to the displacement 12 is gone, the dome shaped contact spring 21 is inverted in the opposite direction, and returns to the initial state.

Also, there is known a switch including a dome shaped contact spring including a spherical section with a spherical surface and a base portion (for example, Japanese Patent No. 4079431, Japanese Patent No. 3753676, Japanese Patent Application Laid-Open Publication No. 2004-139997, and Japanese Patent Application Laid-Open Publication No. 2000-322974). A switch 200 including a dome shaped contact spring including a spherical section and a base section is described with reference to FIG. 16. FIG. 16 shows a cross sectional view of a configuration of the switch 200 including the dome shaped contact spring 22.

As shown in FIG. 16, the switch 200 includes a dome shaped contact spring 22, substrate 3, and fixed contacts 4, 5 and 6. The dome shaped contact spring 22 includes a spherical section 22A and base section 22B. The spherical section 22A is a spring for the contact including a dome shaped metal conductor with a spherical surface. The base section 22B is a circular cone shaped metal conductor connected to the spherical section 22A. The spherical section 22A includes a movable contact 22*a* which is a portion movable with an operation load. The base section 22B is a portion which hardly moves with the operation load.

In the switch 200, compared to the switch 100, the dome shaped contact spring 22 enables the height from the substrate 3 to be lower. Therefore, the switch 200 can be made smaller. Residual stress for clicking action is applied to the dome shaped contact spring 22 with press work in manufacturing.

Lately, there is a demand for electronic devices such as cellular phones, etc. including the switch to be made even smaller. However, with the conventional switch 200, when the height from the substrate 3 is made lower, the buckling does not occur even when the operation load is applied and the clicking action cannot be obtained.

SUMMARY OF THE INVENTION

It is, therefore, an object of the present invention to make an apparatus provided with a dome shaped spring smaller as well as to clearly obtain a clicking action.

According to an aspect of the present invention, there is provided a dome shaped spring including:

a dome shaped spring section in which buckling occurs by pushing, wherein at least a portion of a neutral face of a movable portion when buckling of the dome shaped spring section occurs is an aspherical shape.

According to another aspect of the present invention, there is provided a switch including:

a dome shaped spring section in which buckling occurs by pushing, wherein at least a portion of a neutral face of a movable portion when buckling of the dome shaped spring section occurs is an aspherical shape;

a first fixed contact to constantly be in contact with the dome shaped spring section;

a second fixed contact to be in contact with a movable contact when buckling occurs in the dome shaped spring section; and a substrate on which the first fixed contact and the second fixed contact is provided, wherein the dome shaped spring section is a conductor; and the first fixed contact and the second fixed contact are in an electrically conductive state through the dome shaped spring section when buckling occurs by pushing.

BRIEF DESCRIPTION OF THE DRAWINGS

The above and other objects, advantages, and features of the present invention will become more fully understood from the detailed description given hereinbelow and the appended drawings which are given by way of illustration only, and thus are not intended as a definition of the limits of the present invention, wherein.

DESCRIPTION OF THE PREFERRED EMBODIMENTS

An embodiment of the present invention, first and second modifications and examples 1 and 2 are described in detail in this order with reference to the drawings. However, the scope of the invention is not limited by the illustrated examples.

Figure 1:
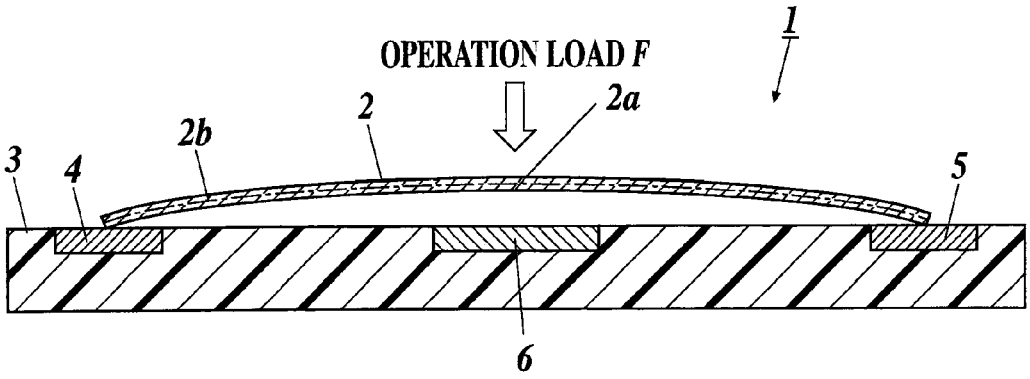
FIG. 1 is a cross sectional view of a switch according to the present embodiment.
Figure 2:
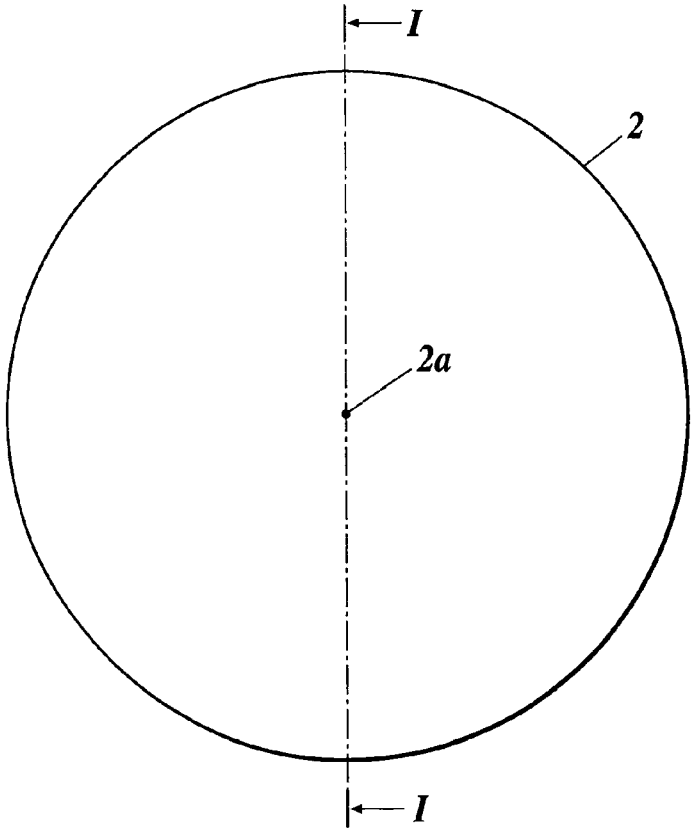
FIG. 2 is a planar view of a dome shaped spring according to the present embodiment.

An embodiment of the present invention is described with reference to FIG. 1 to FIG. 6. First, a configuration of a device of switch 1 of the present embodiment is described with reference to FIG. 1 and FIG. 2. FIG. 1 shows a cross sectional view of the configuration of the switch 1. FIG. 2 is a planar view of the configuration of a dome shaped spring 2. FIG. 1 is a cross sectional view of a switch 1 including a cross sectional view of the dome shaped spring 2 with respect to line I-I shown in FIG. 2.

For example, the switch 1 of the present embodiment is a switch used in an operation section for electronic devices. The electronic device is an electronic device including an operation section where input with a pushing operation is performed, and it is preferable that it is a portable device such as a cellular phone, PHS (Personal Handyphone System), PDA (Personal Digital Assistant), handy terminal, etc.

As shown in FIG. 1, the switch 1 includes a dome shaped spring 2, substrate 3, and fixed contacts 4, 5 and 6. The dome shaped spring 2 is a spring for a contact including a metal conductor in a dome shape where the entire surface is in an aspherical shape. The material of the dome shaped spring 2 is a metal conductor such as stainless steel such as SUS 301 (stainless steel strip for springs), beryllium copper, phosphor bronze for springs, etc. The material is not limited to the above material and can be any material generally used for the purpose of use in springs.

As shown in FIG. 2, the shape of the planar surface of the dome shaped spring 2 is circular. A central point of the plane of the dome shape spring 2 is to be the movable contact 2*a*. A neutral plane of a cross section of the dome shaped spring 2 is to be the neutral plane 2*b*. The neutral plane is a cross section which is in a border of the compression side and the tension side and is not extended or compressed. The neutral plane 2*b* is the aspherical shape. The aspherical shape of the dome shaped spring 2 is described in detail later. Also, the dome shaped spring 2 includes a shape projected in the opposite direction to the pushing direction of the operator.

The substrate 3 is a substrate including glass epoxy resin, etc. The dome shaped spring 2 is placed on the substrate 3. The fixed contacts 4, 5 and 6 are provided on the substrate 3. The fixed contacts 4, 5 and 6 are fixed contacts including a metal conductor such as copper foil. The fixed contacts 4 and 5 are constantly in contact with the edge section of the dome shaped spring 2. The fixed contact 6 is provided in a position corresponding to the movable contact 2*a* of the dome shaped spring 2. The fixed contact 6 is not in contact with the dome shaped spring 2 when the dome shaped spring 2 is not pushed down.

Figure 3:
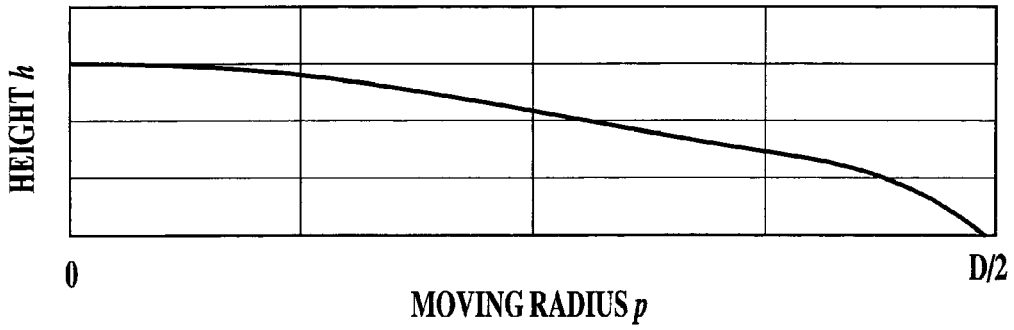
FIG. 3 is a diagram showing a height with respect to a moving radius of the dome shaped spring according to the present embodiment.
Figure 4:
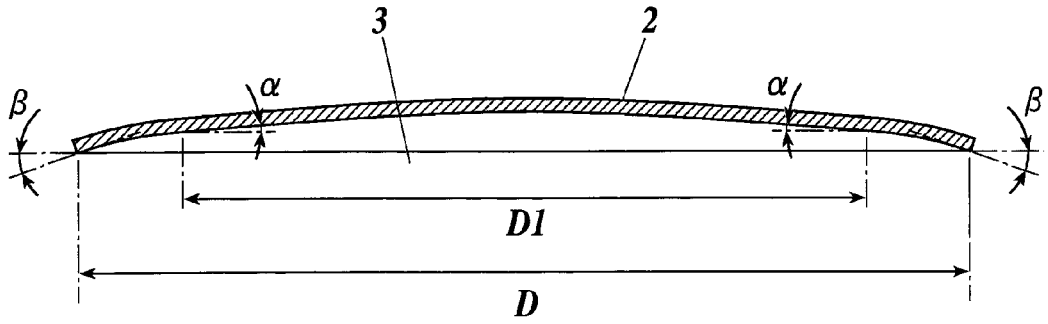
FIG. 4 is a cross sectional view showing an angle of the dome shaped spring according to the present embodiment.

Next, the aspherical shape of the dome shaped spring 2 is described with reference to FIG. 3 and FIG. 4. FIG. 3 shows a height with respect to a moving radius ρ of the dome shaped spring 2. FIG. 4 shows an angle of the dome shaped spring 2.

As shown in FIG. 3 and FIG. 4, the dome shaped spring 2 is designed to include an aspherical shape. The height of the dome-shaped spring 2 in FIG. 3 is a length in a perpendicular direction from the surface of the substrate 3 to the face of the bottom side of the dome shaped spring 2. The diameter of the circle to the edge section where the center point of the dome shaped spring 2 is the center on the surface of the substrate 3 is to be outer diameter D. The length from the center point of the dome shaped spring 2 on the surface of the substrate 3 is to be moving radius ρ. In other words, the moving radius ρ corresponding to the outer diameter D is D/2. The height of the dome shaped spring 2 corresponding to the center point of the dome shaped spring 2 is to be height h.

The dome shaped spring 2 includes a similar aspherical shape in an upper surface, neutral surface and a lower surface. At least the neutral surface of the dome shaped spring 2 is to be the aspherical shape. Therefore, the shape of the lower surface of the dome shaped spring 2 is considered to be the shape of the neutral surface of the dome shaped spring 2 in the description below.

The aspherical shape of the dome shaped spring 2 is a shape represented by the following formula (1) which is an aspherical equation of the even function of six degrees.

$$f(\rho)=a_6\cdot\rho^6+b_6\cdot\rho^4+c_6\cdot\rho^2+h \quad (1)$$

Here, $a_6$, $b_6$ and $c_6$ are arbitrary coefficients.

Also, in the formula (1), a diameter corresponding to the position of an inflection point of the dome shaped spring 2 is to be the length D1. The formula (1) includes three inflection points. The three inflection points are in the position corresponding to the moving radius ρ=0, D1/2, D/2. An angle between the dome shaped spring 2 and the substrate 3 on the moving radius ρ=D1/2 is to be an angle α. An angle between the dome shaped spring 2 and the substrate 3 on the moving radius ρ=D/2 is to be an angle β.

As a condition for the buckling to occur in the dome shaped spring 2 with the operation load F, the following formula (2) needs to be satisfied.

$$\alpha<\beta \quad (2)$$

The values of $a_6$, $b_6$ and $c_6$ which satisfies the formula (2) is determined with the formula (1).

In formula (1), the aspherical shape of the dome shaped spring 2 is represented by the aspherical equation of an even formula of six degrees. Alternatively, the aspherical shape of the dome shaped spring 2 can be represented by an even formula of eight degrees or more. In other words, the aspherical shape of the dome shaped spring 2 is an aspherical shape which satisfies any one of the following formulas (3), (4), etc.

$$f(\rho)=a_8\cdot\rho^8+b_8\cdot\rho^6+c_8\cdot\rho^4+d_8\cdot\rho^2+h \quad (3)$$

$$f(\rho)=a_{10}\cdot\rho^{10}+b_{10}\cdot\rho^8+c_{10}\cdot\rho^6+d_{10}\cdot\rho^4+e_{10}\cdot\rho^2+h \quad (4)$$

etc.

In other words, the aspherical shape of the present embodiment can be collectively represented by the following formula (5).

$$f(\rho)=a_n1\cdot\rho^n+b_n\cdot\rho^{n-2}+c_n\cdot\rho^{n-4}+\ldots+\gamma_n\cdot\rho^2+h \quad (5)$$

Here, n: arbitrary even number of 6 or more, γ: coefficient corresponding to second degree.

The even function of six degrees or more is used in order to obtain three or more inflection points including the moving radius ρ=0 (center point of dome shaped spring 2). Among the three or more inflection points, one of the inflection points corresponds to moving radius ρ=0, another inflection point corresponds to moving radius ρ=outer diameter of the dome shaped spring 2 and another inflection point corresponds to the moving radius ρ which satisfies 0<ρ<outer radius. The dome shaped spring 2 can be made into a shape where buckling occurs when three or more inflection points are included. In other words, the formula (5) with the even function with six or more degrees is used to design a dome shaped spring 2 which satisfies the condition of formula (2) and buckling occurs in the dome shaped spring 2 by the operation load F.

When the dome shaped spring 2 is designed, the higher the number of degree n of the formula (5) is, the aspherical shape can be set to a desirable shape, however, the amount of calculation increases. Therefore, it is preferable that the dome shaped spring 2 is designed with an aspherical equation of a suitable number of degrees such as six degrees, eight degrees, etc.

Figure 5A:
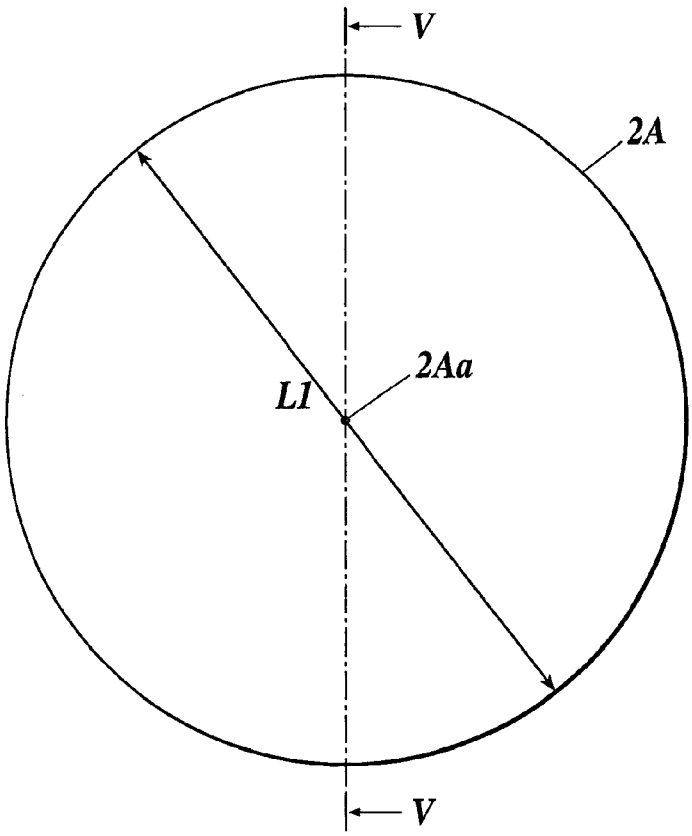
FIG. 5A is a planar view of a dome shaped spring as an example of the present embodiment.
Figure 5B:
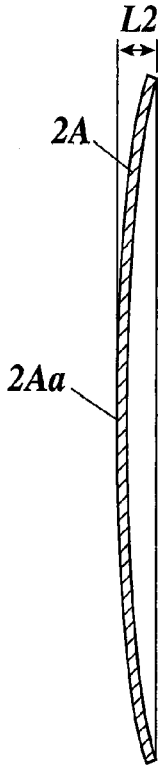
FIG. 5B is a cross sectional view of the dome shaped spring as an example of the present embodiment.
Figure 6A:
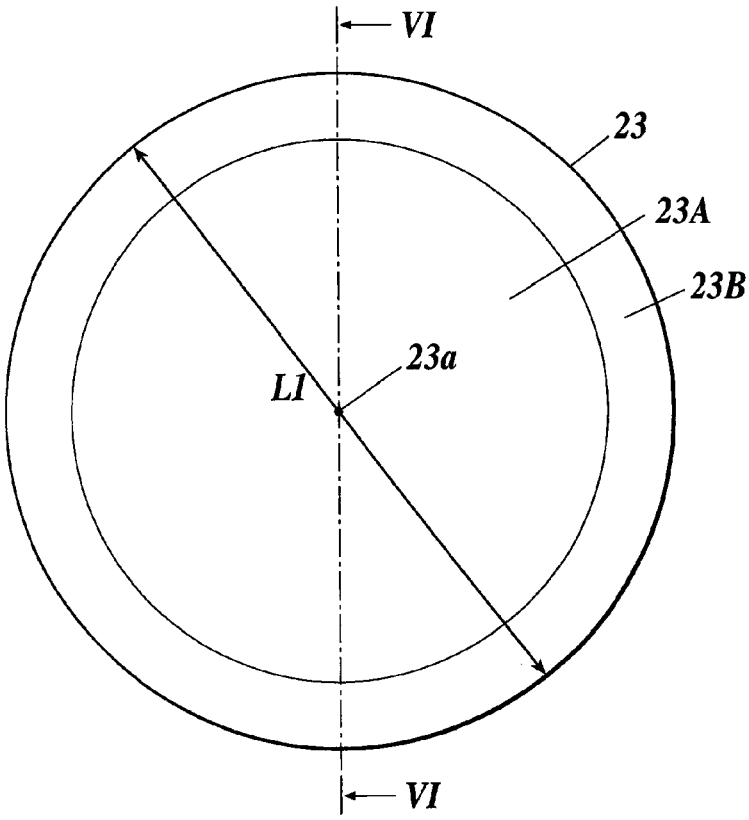
FIG. 6A is a planar view of a dome shaped contact spring as a conventional example.
Figure 6B:
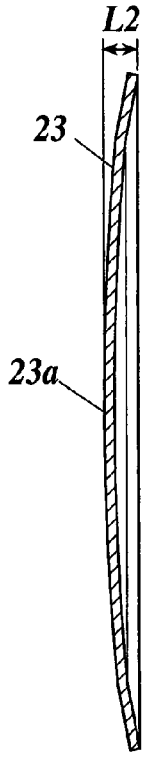
FIG. 6B is a cross sectional view of a dome shaped contact spring as the conventional example.
Figure 7:
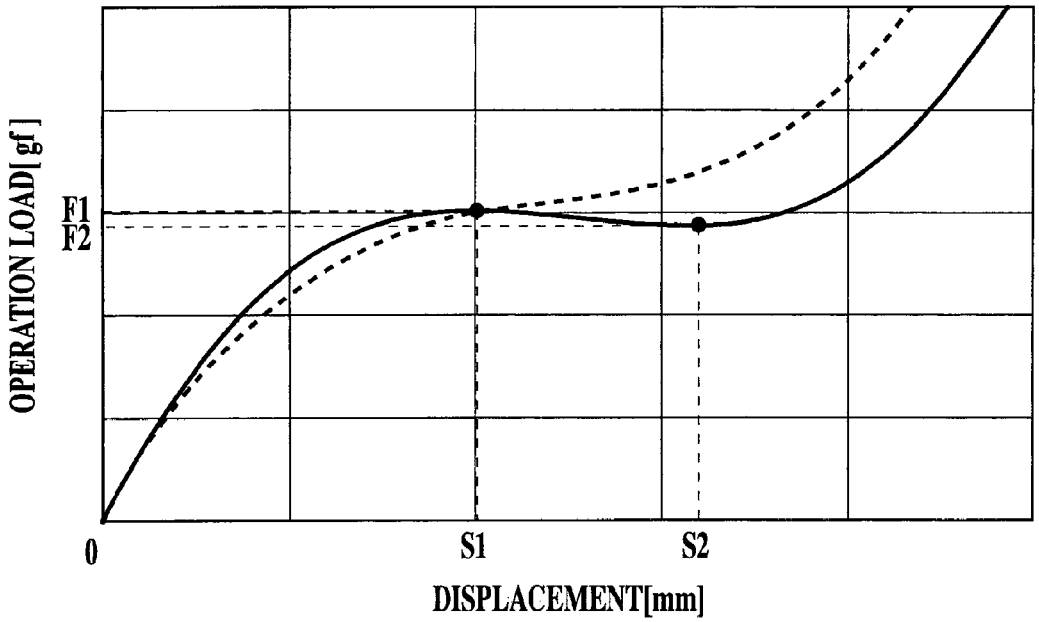
FIG. 7 is a diagram showing a characteristic of an operation load with respect to a displacement of a movable contact of the dome shaped spring of an example of the present embodiment and the dome shaped contact spring of the conventional example.

Next, the operation of an example of a dome shaped spring 2 is described with reference to FIG. 5A to FIG. 7. FIG. 5A shows a planar view of the configuration of the dome shaped spring 2A as an example of the present embodiment. FIG. 5B shows a cross sectional view of the configuration of the dome shaped spring 2A. FIG. 6A shows a planar view of the configuration of the dome shaped contact spring 23 as a conventional example. FIG. 6B shows a cross sectional view of the configuration of the dome shaped contact spring 23. FIG. 7 shows a characteristic of the operation load on the displacement of the movable contact 2Aa and 23*a* of the dome shaped spring 2A and dome shaped contact spring 23.

The dome shaped spring 2A shown in FIG. 5A and FIG. 5B is an example of a dome shaped spring 2 designed using the formula (2) and the formula (3) with the aspherical equation of eight degrees. FIG. 5B is a cross sectional view of the dome shaped spring 2A shown in FIG. 5A taken along line V-V. The dome shaped contact spring 23 shown in FIG. 6A and FIG. 6B are an example of a conventional dome shaped contact spring 22. The dome shaped spring 2A and the dome shaped contact spring 23 are not applied with residual stress for clicking action by press working. FIG. 6B is a cross sectional view of the dome shaped contact spring 23 shown in FIG. 6A taken along line VI-VI. The dome shaped contact spring 23 includes a spherical section 23A including a spherical shape and a base section 23B in a circular cone shape.

An outer diameter on the planar surface of the dome shaped spring 2A and the dome shaped contact spring 23 is to be a length L1 and a height from the substrate to the upper surface of the dome shaped spring 2A and the dome shaped contact spring 23 of the cross section is to be a length L2.

In FIG. 7, a curve of the operation load F [gf] on the displacement [mm] of the movable contact 2Aa in the perpendicular direction with respect to the substrate 3 of the dome shaped spring 2A is represented by a solid line. Similarly, a curve of the operation load F [gf] on the displacement [mm] of the movable contact 23*a* of the dome shaped contact spring 23 is represented by a broken line. FIG. 7 shows a characteristic of the dome shaped spring 2A and the dome shaped contact spring 23 when L1=4 [mm], L2=0.24 [mm] as an example.

It is considered that the operator pushes the movable contact 2Aa or 23*a* at the center of the dome shaped spring 2A or the dome shaped contact spring 23 in a switch including the dome shaped spring 2A or the dome shaped contact spring 23 from above with an operation load F. The initial state of the operation load and displacement where force is not applied to the movable contact 2Aa or 23*a* is to be 0.

In the initial state of the switch, when the operation load F is applied to the dome shaped contact spring 23, first, the operator initiates increase of the operation load F by pushing. As shown in FIG. 7, the operation load F increases almost in proportion from when the displacement is 0 to when the displacement amount is S1. However, even when the displacement amount exceeds S1, the operation load continues to increase with the increase of displacement. Therefore, buckling does not occur in the dome shaped contact spring 23 with the operation load F1.

On the other hand, when the operation load F is applied to the dome shaped spring 2A in the initial state of the switch, as shown in FIG. 7, the operation load F increases almost in proportion from when the displacement is 0 to when the displacement amount is S1. Then, with the operation load F1 corresponding to the displacement amount S1, buckling occurs in the dome shaped spring 2A. The center portion of the dome shaped spring 2A is inverted, and the movable contact 2Aa is displaced with an operation load smaller than the operation load F1. The operation load continues to reduce until the displacement amount S2 where the movable contact 2Aa is in contact with the fixed contact 5. When there is no operation load F2 corresponding to the displacement amount S2, the dome shaped spring 2A is inverted in the opposite direction and returns to the initial state.

According to the present embodiment, the neutral surface 2*b* of the dome shaped spring 2 where buckling occurs by pushing is an aspherical shape. The aspherical shape of the dome shaped spring 2 is represented by a formula (5) and satisfies the formula (2). Therefore, the height of the dome shaped spring 2 can be made smaller and the switch 1 provided with the dome shaped spring 2 can be made smaller and the clicking action can be clearly obtained. In other words, the clicking feel can be clearly provided to the operator.

First Modification

Figure 8:
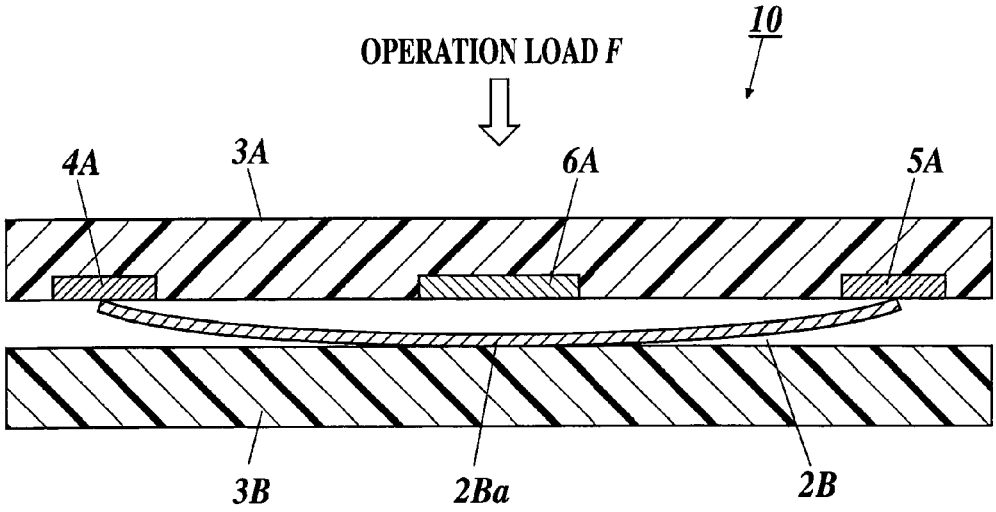
FIG. 8 is a cross sectional view of a first modification of a switch.

The first modification of the above described embodiment is described with reference to FIG. 8. FIG. 8 shows a cross sectional view of the configuration of the switch 10 of the present modification.

The switch 1 of the above described embodiment is a configuration including a dome shaped spring 2 including a projected shape in a direction opposite to the pushing direction of the operator. On the other hand, the switch 10 of the modification includes a dome shaped spring 2B including a projecting shape in the same direction as the pushing direction of the operator.

As shown in FIG. 8, the switch 10 includes a dome shaped spring 2B, substrates 3A and 3B, and fixed contacts 4A, 5A and 6A. The dome shaped spring 2B is a contact spring including a metal conductor such as stainless steel in a dome shape where the neutral surface is an aspherical shape similar to the dome shaped spring 2. The shape of the planar surface of the dome shaped spring 2B is circular. The center point of the planar surface of the dome shaped spring 2B is to be the movable contact 2Ba.

The substrate 3A is provided above the dome shaped spring 2B and is a substrate placed on the dome shaped spring 2B. The substrate 3B is provided below the dome shaped spring 2B and the dome shaped spring 2B is placed on the substrate 3B. The substrate 3A is provided with fixed contacts 4A, 5A and 6A. The fixed contacts 4A, 5A and 6A are electrical contacts including a metal conductor such as copper foil. The fixed contacts 4A and 5A are in constant contact with the edge section of the dome shaped spring 2B. The fixed contact 6A is provided in a position corresponding to the movable contact 2Ba of the dome shaped spring 2B. The fixed contact 6A is not in contact with the dome shaped spring 2B when the dome shaped spring 2B is not pushed. The substrate 3B is in contact with the movable contact 2Ba when the dome shaped spring 2B is not pushed.

As for the switch 10 also, similar to the switch 1, when the dome shaped spring 2B is pushed from an initial state without the operation load F, and the operation load F is applied and increased on the movable contact 2Ba, buckling occurs in the dome shaped spring 2B at a certain displacement and the center portion is inverted, and the movable contact 2Ba is displaced with a small operation load F. Then, the movable contact 2Ba is in contact with the fixed contact 6A and the operation load F continues to decrease. Then, when there is no more operation load F, the dome shaped spring 2B is inverted in the opposite direction and returns to the initial state.

According to the present modification, similar to the above embodiment, the switch 10 can be made smaller and the clicking action can be clearly obtained by the dome shaped spring 2B.

Also, the fixed contacts 4A, 5A and 6A are provided on the substrate 3. Therefore, the fixed contacts 4A, 5A and 6A can be provided above the dome shaped spring 2.

Second Modification

Figure 9A:
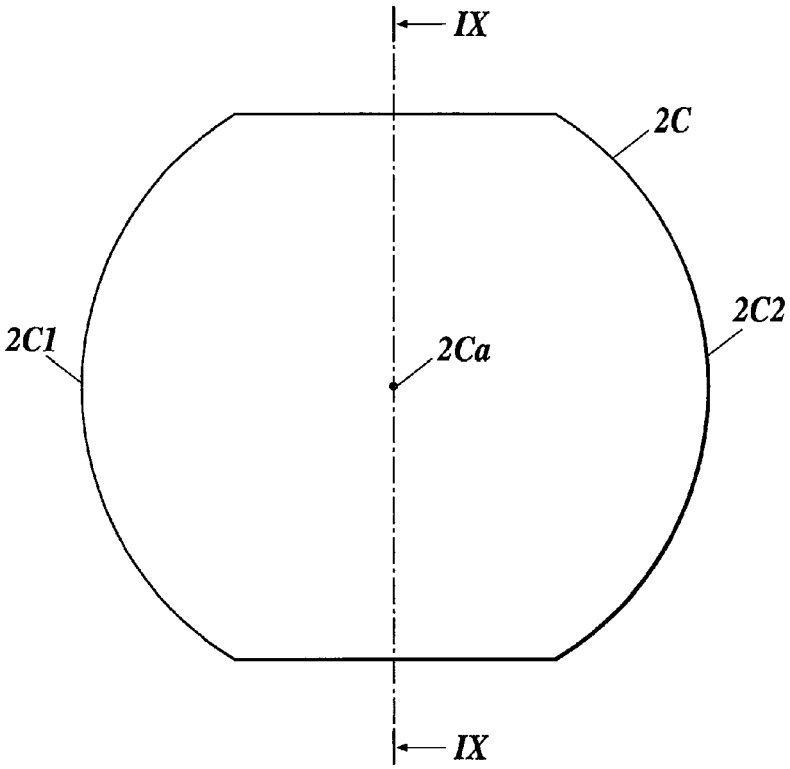
FIG. 9A is a planar view of a first dome shaped spring of a second modification.
Figure 9B:
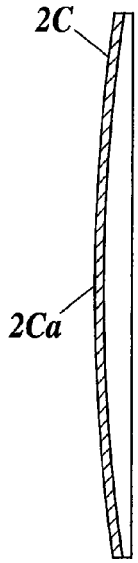
FIG. 9B is a cross sectional view of a first dome shaped spring of a second modification.
Figure 10A:
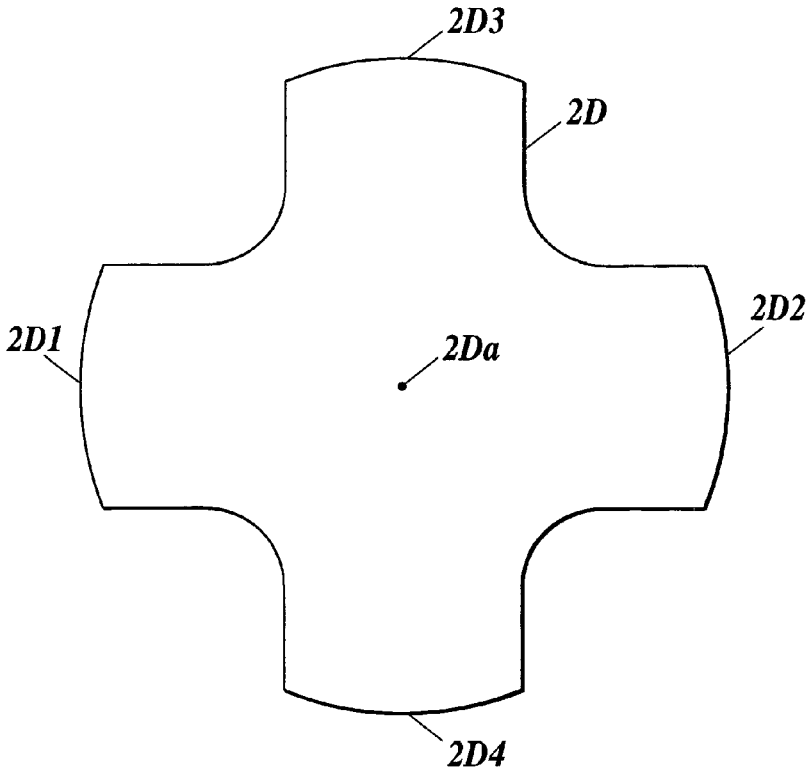
FIG. 10A is a planar view of a second dome shaped spring of a second modification.
Figure 10B:
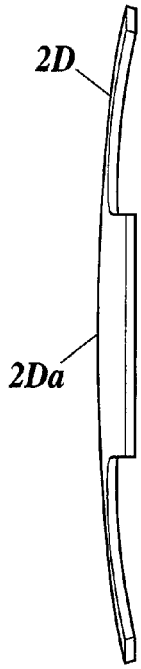
FIG. 10B is a side view of a second dome shaped spring of a second modification.
Figure 11A:
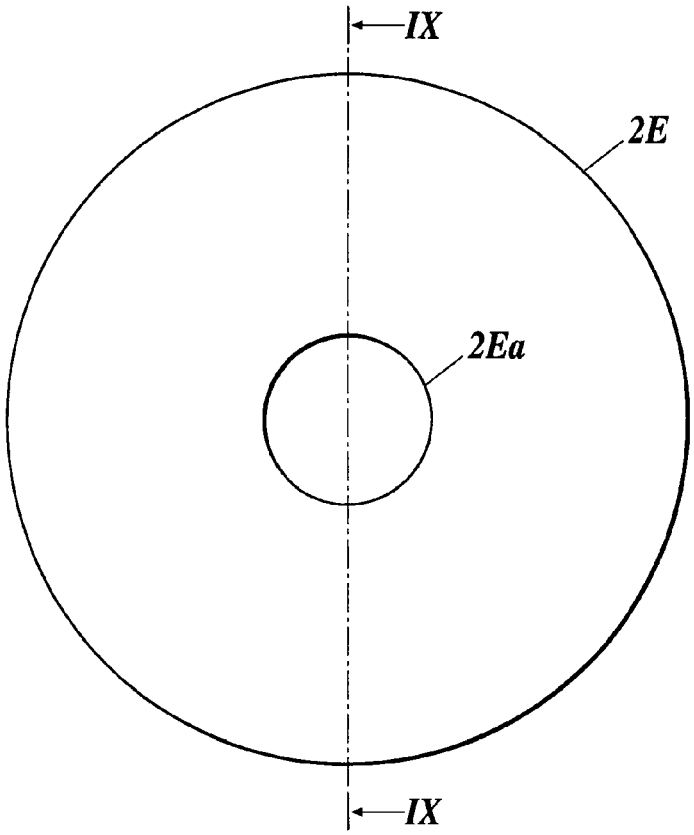
FIG. 11A is a planar view of a third dome shaped spring of a second modification.
Figure 11B:
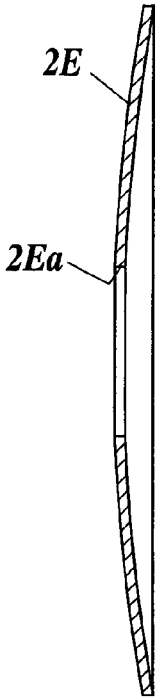
FIG. 11B is a cross sectional view of a third dome shaped spring of a second modification.

The second modification of the above described embodiment is described with reference to FIG. 9A to FIG. 11B. FIG. 9A shows a planar view of a configuration of a dome shaped spring 2C of the present modification. FIG. 9B shows a cross sectional view of a configuration of the dome shaped spring 2C. FIG. 10A shows a planar view of a configuration of a dome shaped spring 2D of the present modification. FIG. 10B shows a side view of the configuration of the dome shaped spring 2D. FIG. 11A shows a planar view of a configuration of a dome shaped spring 2E of the present modification. FIG. 11B shows a cross sectional view of a configuration of the dome shaped spring 2E.

The switch 1 of the above described embodiment is a configuration including the dome shaped spring 2 where the shape of the planar surface is circular. Instead of the dome shaped spring 2, the switch of the present modification is a configuration including dome shaped spring 2C, 2D or 2E where a portion of the dome shaped spring 2 is cut.

As shown in FIG. 9A and FIG. 9B, the dome shaped spring 2C includes a dome shape where a portion of the top and bottom of the dome shape is cut to form a round rectangular shape. FIG. 9B is a cross sectional view of the dome shaped spring 2C along line IX-IX shown in FIG. 9A. The dome shaped spring 2C is manufactured by cutting the top and bottom edge section of the dome shaped spring 2. Therefore, the dome shaped spring 2C includes an aspherical shape similar to the dome shaped spring 2. In the dome shaped spring 2C, among the edge sections which are not cut, the two edge sections 2C1 and 2C2 facing each other with the movable contact 2Ca of the center in between are in contact with the fixed contacts 4 and 5 of the substrate 3.

As shown in FIGS. 10A and 10B, the dome shaped spring 2D includes a dome shape where four portions are cut from the dome shape to form a cross shape. FIG. 10B is a side view of the dome shaped spring 2D shown in FIG. 10A. The dome shaped spring 2D is manufactured by cutting four edge sections of the dome shaped spring 2. Therefore, the dome shaped spring 2D includes an aspherical shape similar to the dome shaped spring 2. In the dome shaped spring 2D, among the edge sections which are not cut, the two edge sections 2D1 and 2D2 or 2D3 and 2D4 facing each other with the movable contact 2Da of the center in between are in contact with the fixed contacts 4 and 5 of the substrate 3.

As shown in FIGS. 11A and 11B, the dome shaped spring 2E includes a dome shape where a center portion of the dome shape is cut out into a pierced shape. FIG. 11B is a cross sectional view of the dome shaped spring 2E shown in FIG. 11A taken along line XI-XI. The dome shaped spring 2E is manufactured by cutting the center portion of the dome shaped spring 2 into a circle. The edge section of the dome shaped spring 2E on the hole side is to be the movable contact 2Ea. Therefore, the dome shaped spring 2E includes an aspherical shape similar to the dome shaped spring 2. In the dome shaped spring 2E, two arbitrary edge sections facing each other with the movable contact 2Ea of the center in between are in contact with the fixed contacts 4 and 5 of the substrate 3 similar to the dome shaped spring 2. The fixed contact 6 is formed and placed so as to be in contact with the movable contact 2Ea when the buckling occurs in the dome shaped spring 2E.

According to the above described modification, similar to the above described embodiment, the switch can be made smaller and the clicking action can be clearly achieved by the dome shaped spring 2C, 2D or 2E.

Also, a portion of the dome shaped spring 2C, 2D or 2E is cut. Therefore, the amount of material necessary to form the dome shaped spring 2C, 2D or 2E can be decreased and the dome shaped spring and the switch can be made lighter.

Example 1

Figure 12:
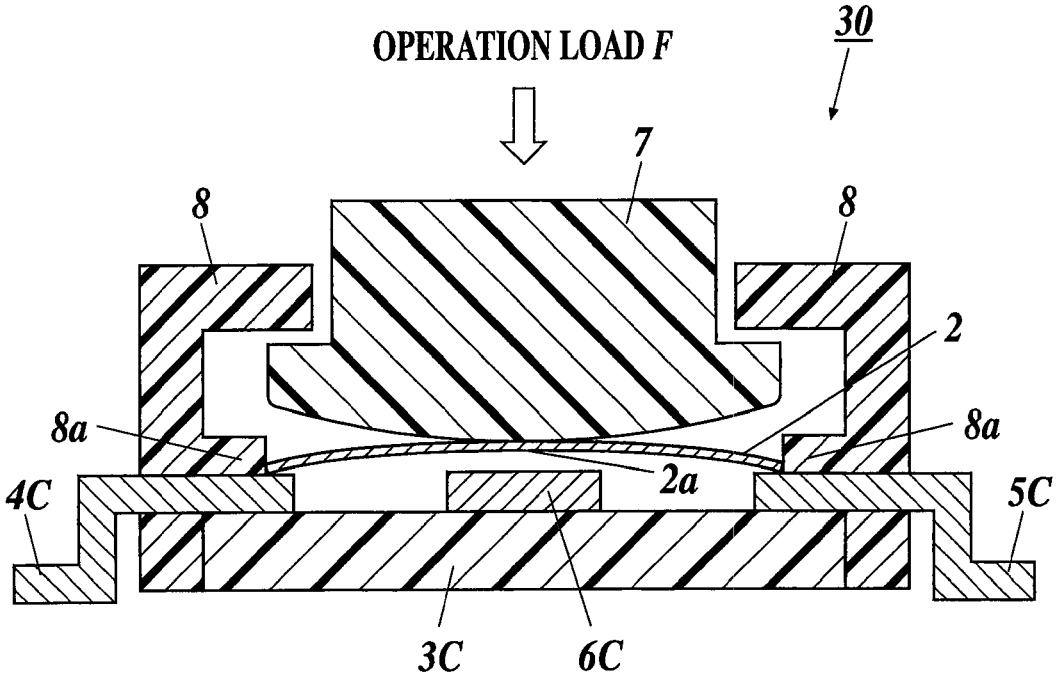
FIG. 12 is a cross sectional view of a switch of example 1.

A switch 30 as a first example of the switch 1 of the present embodiment is described with reference to FIG. 12. FIG. 12 shows a cross sectional view of the configuration of the switch 30 of the present embodiment.

The switch 30 is a push button switch provided on an operation section, etc. in a portable device, etc. The switch 30 includes a dome shaped spring 2, a substrate 3C, fixed contacts 4C, 5C and 6C, an operation button 7 and a switch case 8. The substrate 3C and fixed contacts 4C, 5C and 6C correspond to the substrate 3 and fixed contacts 4, 5 and 6 respectively. Below, the same reference numerals are applied to the members which are the same as the embodiment, and the description is omitted.

The substrate 3C is a substrate including glass-epoxy resin, etc. The fixed contacts 4C, 5C and 6C, which are to be connected to the dome shaped spring 2, are placed on the substrate 3C. The fixed contacts 4C, 5C and 6C are electrical contacts including metal conductors such as copper foil. The fixed contacts 4C and 5C are in constant contact with the edge section of the dome shaped spring 2. The fixed contact 6C is provided in a position corresponding to the movable contact 2*a* of the dome shaped spring 2. The fixed contact 6C is not in contact with the dome shaped spring 2 when the dome shaped spring 2 is not pushed.

The operation button 7 includes a resin such as an ABS resin and is an operation button to receive input of pushing by the operator. The operation button 7 is in contact with the upper portion of the dome shaped spring 2. When the operation button 7 receives the input of pushing by the operator, the operation button 7 moves up and down along the switch case 8 according to the input of pushing and transmits the operation load F corresponding to the input of pushing to the dome shaped spring 2. The switch case 8 is a case including resin such as plastic, etc. The switch case 8 covers the dome shaped spring 2, substrate 3C, fixed contact 4C, 5C and 6C and operation button 7 and also exposes a portion of the operation button 7. The switch case 8 guides the operation button 7 in a vertical direction.

The switch case 8 includes a fixing section 8*a*. The fixing section 8*a* fixes a position of the dome shaped spring 2 from a view of the upper surface. This position is a position where the dome shaped spring 2 is in contact with the fixed contacts 4C and 5C and a position where the movable contact 2Aa of the dome shaped spring 2 is in contact with the fixed contact 6C when buckling occurs.

According to the example 1, similar to the present embodiment, the switch 30 can be made smaller and the clicking action can be clearly obtained by the dome shaped spring 2. The switch 30 includes an operation button 7. Therefore, the operator can perform operation of input by pushing easily with the operation button 7.

The switch 30 includes a switch case 8 including a fixing section 8*a*. Consequently, the fixing section 8*a* allows the dome shaped spring 2 to be reliably placed in a position in constant contact with the fixed contacts 4C and 5C and in contact with the fixed contact 6C when buckling occurs.

Example 2

Figure 13:
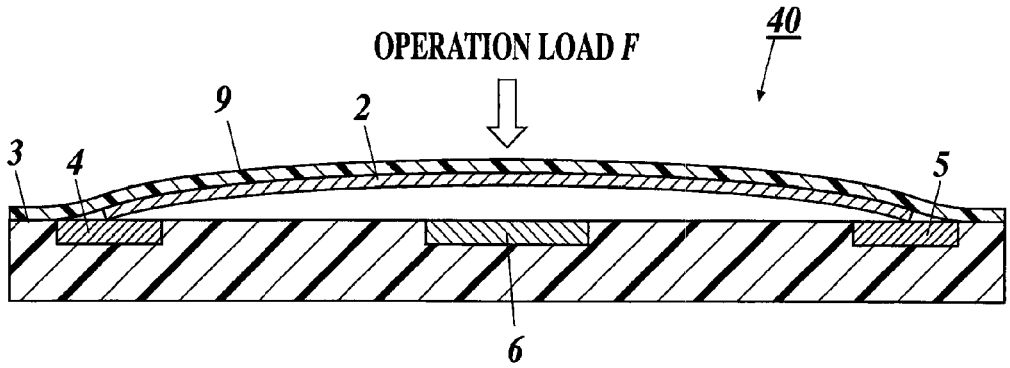
FIG. 13 is a cross sectional view of a switch of example 2.
Figure 14:
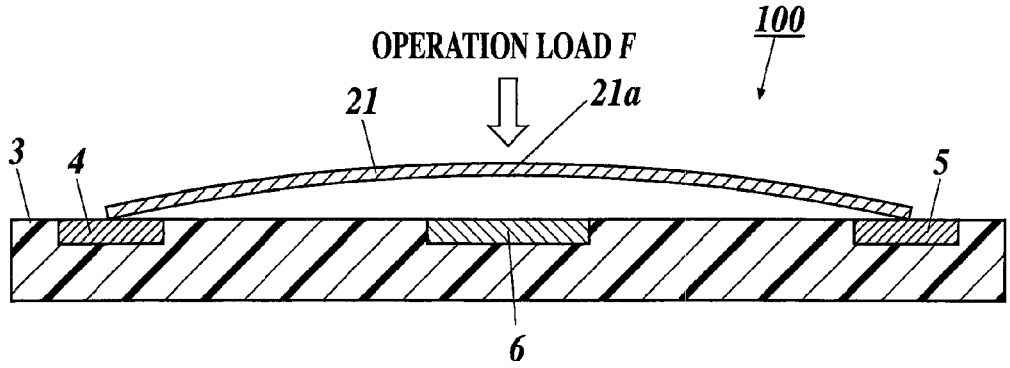
FIG. 14 is a cross section view of a conventional first switch.
Figure 15:
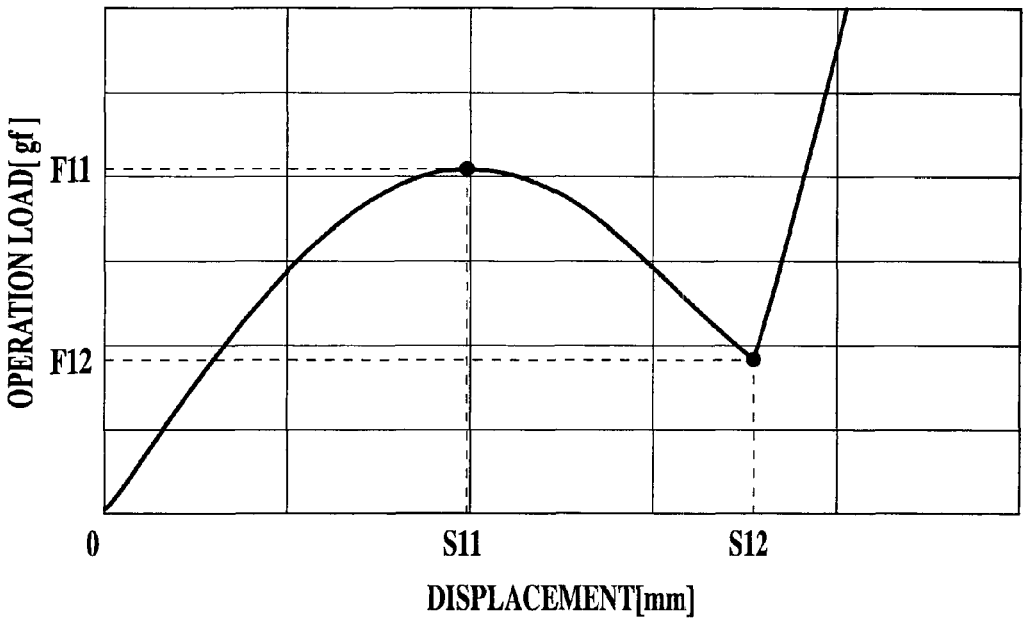
FIG. 15 is a diagram showing a characteristic of operation load with respect to displacement of a movable contact of the conventional first switch.
Figure 16:
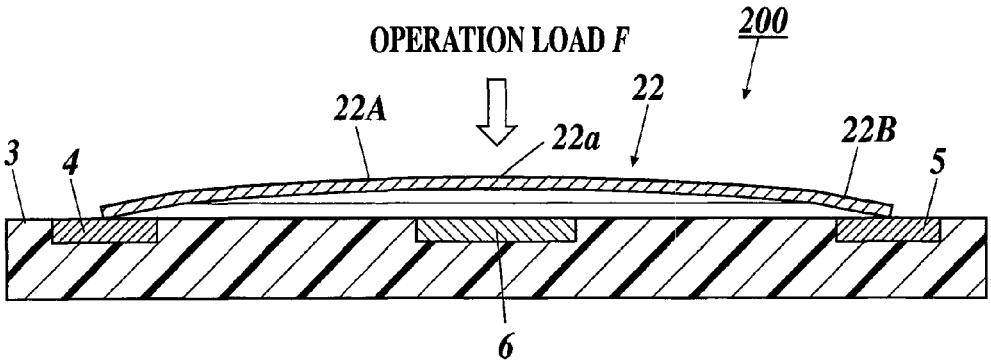
FIG. 16 is a cross sectional view of a conventional second switch.

A switch 40 as a second example of the switch 1 of the above described embodiment is described with reference to FIG. 13. FIG. 13 shows a cross sectional view of a configuration of the switch 40 of the present embodiment.

The switch 40 is a push button switch provided on an operation section, etc. in a portable device, etc. The switch 40 includes a dome shaped spring 2, substrate 3, fixed contacts 4, 5 and 6 and spring pressing sheet 9.

The spring pressing sheet 9 is an insulating sheet such as polyester film. The spring pressing sheet 9 is attached to the upper surface of the dome shaped spring 2 and the substrate 3. The spring pressing sheet 9 fixes the position of the dome shaped spring 2 seen from the upper surface. This is the position where the dome shaped spring 2 is in contact with the fixed contacts 4 and 5 and the movable contact 2Aa of the dome shaped spring 2 is in contact with the fixed contact 6 when buckling occurs.

According to the example 2, similar to the above described embodiment, the switch 40 can be made smaller and the clicking action can be clearly obtained by the dome shaped spring 2. The switch 40 includes the spring pressing sheet 9. Consequently, the spring pressing sheet 9 allows the dome shaped spring 2 to be reliably placed in a position in constant contact with the fixed contacts 4 and 5 and in contact with the fixed contact 6 when buckling occurs. Further, the spring pressing sheet 9 allows the switch 40 to be made with a lower height and smaller than the switch 30 of the first example.

The description of the above described embodiment, modifications and examples are examples of the dome shaped spring and the switch of the present embodiment, and the present invention are not limited to the above.

For example, at least two of the configurations of the above described embodiment, modifications and examples can be suitably combined. For example, the dome shaped spring 2 of the switch 30 of the above described example 1 can be replaced by the dome shaped springs 2C, 2D and 2E described in the above described second modification. Also, for example, in the switch 30 of the above described example 1, there can be no fixing section 8*a* and the spring pressing sheet 9 of the above described example 2 can be attached to the dome shaped spring 2 for alignment.

The dome shaped springs of the above described embodiment, modifications and examples are a configuration where the neutral surface of the entire surface is an aspherical shape, however, the configuration is not limited to the above. At least a portion of the movable portion of the dome shaped spring when buckling occurs can be an aspherical shape. For example, a circle portion of the center of the dome shaped spring can be a spherical shape and the other portions can be an aspherical shape.

In the above described embodiments, modifications and embodiments, a switch is described as the apparatus provided with a dome shaped spring but the present invention is not limited to the above. The aspherical dome shaped spring can be provided in other apparatuses such as a connector, etc. For example, when the aspherical dome shaped spring is used in a connector, the contact of the connector can be the aspherical dome shaped spring and when the connector is connected, the clicking action can occur with the dome shaped spring. In other words, when the connector is connected to the connection destination, with the buckling of the dome shaped spring, the clicking action occurs and the contact of the connector and the contact of the connection destination are in an electrically conductive state through the dome shaped spring. Therefore, a clicking feel can be provided to the operator and the connector can be made smaller.

The aspherical dome shaped spring can be provided in apparatuses such as a connector, etc. without using the aspherical dome shaped spring as a contact. For example, when the aspherical dome shaped spring is used in the connector, the dome shaped spring is used in the housing, etc. of the connector, and when the connector is connected, the clicking action occurs by the dome shaped spring. In other words, when the connector is connected, the contact of the connector and the contact of the connection destination is in an electrically conductive state, and separately, the clicking action occurs when the buckling occurs in the dome shaped spring. Therefore, the clicking feel can be provided to the operator to notify connection is completed and the connector can be made smaller.

The detailed configuration and operation of the dome shaped spring and the switch of the above described embodiment, modifications and examples can be suitably modified without leaving the scope of the invention.

According to an aspect of the preferred embodiments of the present invention there is provided a dome shaped spring comprising:

a dome shaped spring section in which buckling occurs by pushing, wherein at least a portion of a neutral face of a movable portion when buckling of the dome shaped spring section occurs is an aspherical shape.

Preferably, in the dome shaped spring, the aspherical shape is represented by an even function of six degrees or more; and an angle $\alpha$ and an angle $\beta$ satisfy a relation of $\alpha<\beta$, the angle $\alpha$ is an angle between the dome shaped spring section at an inflection point of the even function corresponding to a position between a center and an outer diameter of the dome shaped spring section, and a substrate in contact with an edge section of the dome shaped spring section, and the angle $\beta$ is an angle between the dome shaped spring section at an inflection point of the even function corresponding to the outer diameter of the dome shaped spring section and the substrate.

Preferably, in the dome shaped spring, the dome shaped spring section includes a shape where a portion is cut.

According to an aspect of the preferred embodiments of the present invention there is provided a switch including:

a dome shaped spring section in which buckling occurs by pushing, wherein at least a portion of a neutral face of a movable portion when buckling of the dome shaped spring section occurs is an aspherical shape;

a first fixed contact to constantly be in contact with the dome shaped spring section;

a second fixed contact to be in contact with a movable contact when buckling occurs in the dome shaped spring section; and a substrate on which the first fixed contact and the second fixed contact is provided, wherein the dome shaped spring section is a conductor; and the first fixed contact and the second fixed contact are in an electrically conductive state through the dome shaped spring section when buckling occurs by pushing.

Preferably, the switch further includes a spring pressing sheet applied on the dome shaped spring section.

Preferably, the switch further includes an operation button to receive input of pushing and to transmit the pushing to the dome shaped spring section.

According to the above aspects, the apparatus provided with the dome shaped contact spring can be made smaller and the clicking action can be clearly obtained.

The entire disclosure of Japanese Patent Application No. 2009-182939 filed on Aug. 6, 2009 including description, claims, drawings and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. A dome shaped spring comprising:

a dome shaped spring section configured to buckle when pushed, and a substrate in contact with an edge section of the dome shaped spring section, wherein:

the dome shaped spring section includes a movable portion when buckling of the dome shaped spring section occurs, and the movable portion includes a neutral face having an aspherical shape, the aspherical shape is represented by an even function of at least six degrees, and an angle $\alpha$ and an angle $\beta$ satisfy a relation of $\alpha<\beta$, the angle $\alpha$ being an angle between (i) the dome shaped spring section at an inflection point of the even function corresponding to a position between a center and an outer diameter of the dome shaped spring section and (ii) the substrate, and the angle $\beta$ being an angle between (i) the dome shaped spring section at an inflection point of the even function corresponding to the outer diameter of the dome shaped spring section and (ii) the substrate.

2. The dome shaped spring according to claim 1, wherein the dome shaped spring section includes a shape where a portion is cut.

3. A switch comprising:

the dome shaped spring section according to claim 1;

a first fixed contact to constantly be in contact with the dome shaped spring section;

a second fixed contact to be in contact with a movable contact when buckling occurs in the dome shaped spring section;

wherein the first fixed contact and the second fixed contact are provided on the substrate, and the dome shaped spring section is a conductor; and wherein the first fixed contact and the second fixed contact are in an electrically conductive state through the dome shaped spring section when buckling occurs by pushing.

4. The switch according to claim 3, further comprising a spring pressing sheet applied on the dome shaped spring section.

5. The switch according to claim 3, further comprising an operation button to receive input of pushing and to transmit the pushing to the dome shaped spring section.

* * * * *